United States Patent [19]

Rozmestor

[11] Patent Number: 4,809,848

[45] Date of Patent: Mar. 7, 1989

[54] ARTICLE HOLDER

[75] Inventor: Raymond L. Rozmestor, Westville, N.J.

[73] Assignee: Advanced Concept Tools, Inc., Edgewater Park, N.J.

[21] Appl. No.: 128,898

[22] Filed: Dec. 4, 1987

Related U.S. Application Data

[63] Continuation-in-part of Ser. No. 858,166, May 1, 1986, Pat. No. 4,711,353.

[51] Int. Cl.[4] ..... B65D 85/02

[52] U.S. Cl. ..... 206/303; 206/3; 206/443; 206/805

[58] Field of Search ..... 206/3, 303, 372, 378, 206/443, 805; 211/68, 70.6, 69

[56] References Cited

U.S. PATENT DOCUMENTS

| | | | |
|---|---|---|---|
| 1,712,473 | 5/1929 | McWethy | 206/378 |
| 3,113,689 | 12/1963 | Moussong | 206/3 |
| 3,272,329 | 9/1966 | Mehalov | 206/443 |
| 3,510,367 | 5/1970 | Freire et al. | 206/3 |
| 4,257,520 | 3/1981 | Hohmann et al. | 206/3 |
| 4,711,353 | 12/1987 | Rozmestor | 206/378 |
| 4,722,436 | 2/1988 | Moraine | 206/3 |

*Primary Examiner*—David T. Fidei

*Attorney, Agent, or Firm*—Fleit, Jacobson, Cohn & Price

[57] ABSTRACT

An article holder having general utility for receiving and securely holding various articles, objects or other entities in a secure and safe manner. The article holder includes a wall, base or other supporting panel-like structure having an opening therein having a periphery defined by a plurality of circumferentially spaced segments forming a receiver for an article, object or other entity together with resilient means which resists radial expansion of the segments and exerts radial inward force on the segments for secure engagement with an article, object or other entity inserted into the receiver defined by the circumferentially spaced segments. The shape or configuration, size and materials from which the article holder is constructed may be varied depending upon the end use requirements.

16 Claims, 3 Drawing Sheets

ARTICLE HOLDER

CROSS-REFERENCE TO RELATED APPLICATION

This application is a continuation-in-part of my copending application U.S. Ser. No. 858,166 filed May 1, 1986 for SOCKET ORGANIZER, now U.S. Pat. No. 4,711,353, issued Dec. 27, 1987.

BACKGROUND OF THE INVENTION

1. Field Of The Invention

The present invention generally relates to an article holder having general utility for receiving and securely holding various articles, objects or other entities in a secure and safe manner. The article holder includes a wall, base or other supporting panel-like structure having an opening therein having a periphery defined by a plurality of laterally extending segments forming a receiver for an article, object or other entity together with resilient means which resists radial expansion of the segments and exerts radial inward force on the segments for secure engagement with an article, object or other entity inserted into the receiver defined by the circumferentially spaced segments. The shape or configuration, size and materials from which the article holder is constructed may be varied depending upon the end use requirements.

2. Information Disclosure Statement

Various prior patents exist which relate to devices which support articles, objects and other entities in various manners depending upon end use requirements. The prior patents of record in Ser. No. 858,166 disclose devices of this type known to applicant. However, none of the prior patents disclose structural features equivalent to the structural features of the present invention. A separate information disclosure statement will be filed in this case.

SUMMARY OF THE INVENTION

An object of the present invention is to provide an article holder for receiving and securely retaining an article, object or other entity incorporating the generally tubular receiver formed by a plurality of circumferentially spaced and radially expandable and contractible segments provided with resilient means associated therewith for resisting outward radial expansion and biasing the segments radially inwardly towards an innermost position for securely engaging and retaining various articles, objects or other entities securely in the receiver within a size and shape range commensurate with the size and shape of the segments and resilient means.

Another object of the invention is to provide an article holder in accordance with the preceding object in which the transverse configuration of the receiver may vary depending upon the article, object or other entity to be received for securely and resiliently engaging the periphery of the article, object or other entity over a substantial portion of the peripheral surface area.

A further object of the present invention is to provide an article holder in accordance with the preceding objects in which the receiver includes a tapering portion at one or both ends to facilitate insertion of an article, object or other entity into either end of the receiver with the segments providing surface area contact with the article, object or other entity inserted into the receiver for securely retaining the article, object or entity in place.

Still another object of the invention is to provide an article holder in accordance with the preceding objects in which the receiver includes a limit stop to limit insertion of an article, object or other entity into the receiver together with a structure for elevating an article, object or other entity in relation to the receiver to provide optimum access thereto.

Still another important object of the present invention is to provide an article holder in accordance with the preceding objects in which the segments defining the receiver have various structural features to enable the segments to be utilized in combination with any number of similar segments or a single segment may be provided in some instances to effectively receive and retain various types of articles, objects or other entities with the article holder preferably being constructed of plastic material although other materials may be utilized with the resilient means including memory characteristics of the plastic material as well as various types of associated resilient structures.

Yet another object of the invention is to provide an article holder in accordance with the preceding objects consisting of one or more segments defining a receiver and resilient means associated with the segments for securely receiving and retaining various articles, objects and other entities with or without article stops and elevators in which the structure is relatively simple and easy to use for various purposes and constructed with long-life expectancy with minimum upkeep, repair and maintenance.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
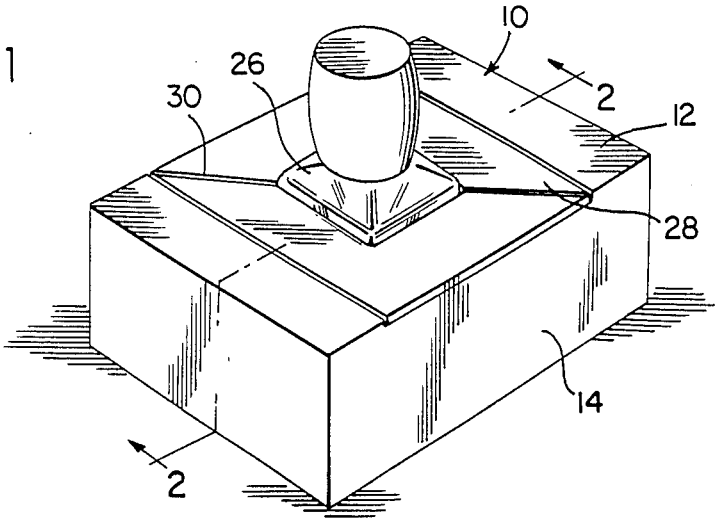
FIG. 1 is a perspective view of an embodiment of the article holder of the present invention for receiving a square or other polygonal container or other entity.
Figure 2:
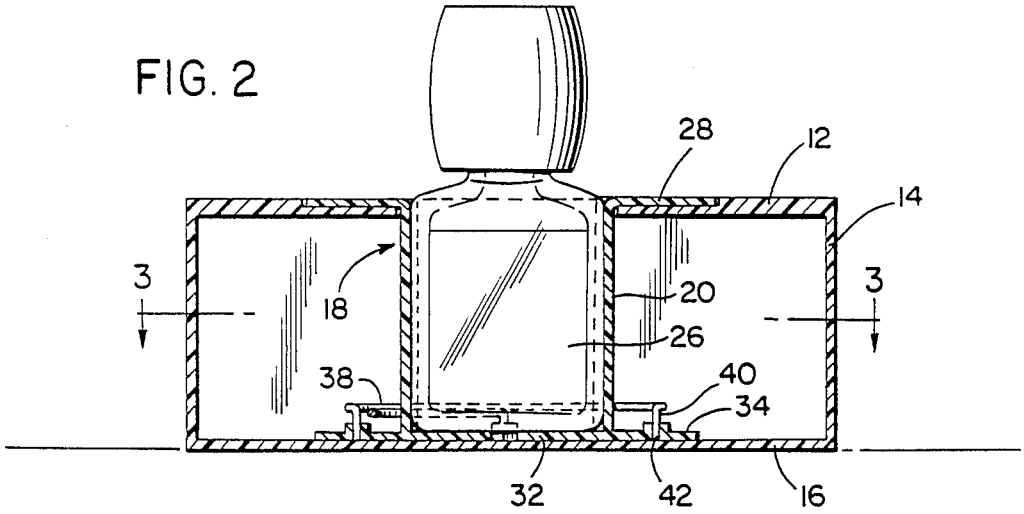
FIG. 2 is a vertical sectional view taken along section line 2—2 on FIG. 1.
Figure 3:
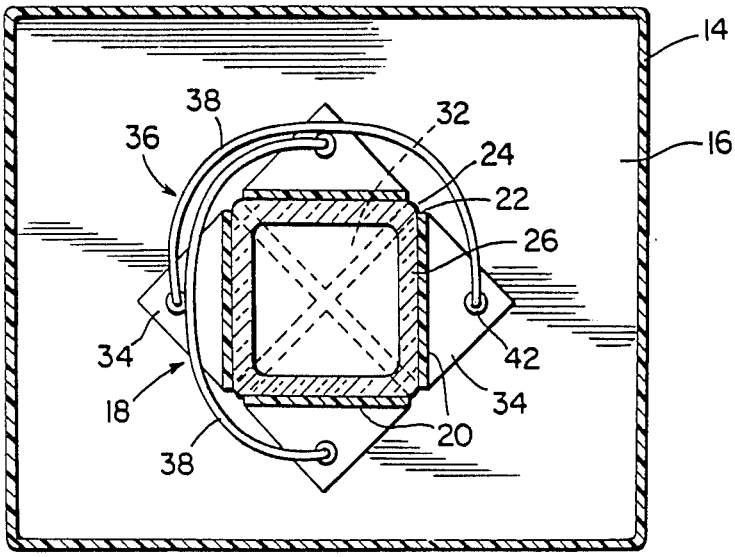
FIG. 3 is a horizontal, sectional view taken along section line 3—3 on FIG. 2.

Referring now specifically to FIGS. 1–3, the article holder illustrated therein is designated by reference numeral 10 and includes a wall, panel, base or the like 12 which in the embodiment illustrated is in the form of a top wall of a hollow structure which also includes a peripheral wall 14 and a bottom wall 16 to define a container or receptacle which includes an article receiver generally designated by the numeral 18 therein with the receiver including a plurality of generally parallel segments 20 which are provided with free side edges 22 which define slots or longitudinal slits 24 to form a receiver for an article 26 which in this embodiment of the invention is disclosed as a square bottle or container but which may be of any configuration or size. The upper end of each segment 20 is provided with a laterally extending flange 28 that is integral with one or more of the wall segments 20. As illustrated, two adjacent segments 20 are integral with a flange 28 and the opposed two segments 20 are integral with an opposed flange 28 with a diagonal slot 30 being formed between the flanges 28 with the slot 30 being continuous with opposed slots 24. It is pointed out that each of the receiver wall segments 20 may be provided with an integral flange and the number of wall segments and flanges and the configuration of the wall segments and flanges may vary depending upon the shape, size and configuration of the article 26.

The bottom of each receiver wall segment 20 includes an inwardly extending triangular flange 32 and an outwardly extending triangular flange 34. The inwardly extending flanges 32 form a limit for insertion of the article 26 into the receiver 18 inasmuch as these flanges form a stop to be engaged by the inner end or bottom of the article 26. The outwardly extending flanges 34 as well as the inwardly extending flanges 32 are disposed adjacent the inner surface of the bottom wall 16 with it being pointed out that the structure may or may not include a bottom wall 16 but the flanges 32 and 34 would operate in the same manner.

A resilient means generally designated by numeral 36 interconnects the flanges 34 in order to resiliently resist outward movement of the wall segments 20 and to resiliently bias the wall segments 20 radially inwardly.

The resilient structure 36 includes a pair of generally U-shaped wire springs 38 each of which is provided with a depending end 40 received in a socket or aperture 42 in opposed flanges 34 as illustrated in FIG. 3. The U-shaped spring 38 engaging opposed pairs of flanges 34 resiliently biases the opposed flanges 34 inwardly thus resiliently biasing opposed receiver wall segments 20 inwardly into frictional gripping engagement with the periphery of the article 26 with the wall segments 20 having substantial surface-to-surface engagement with the article 26.

The receiver 18 may be used as a general utility article holder for various items and will securely hold and retain various articles. The resilient contraction means provides a structure which enables the wall segments to conform to the configuration and contours of the article 26 by resisting outward radial movement of the wall segments 20 and bias the wall segments 20 inwardly to insure surface area contact to increase frictional forces and pressure forces placed on the article for secure holding. While a square or rectangular article is shown, the basic structure may be utilized in various shapes, sizes and configurations to hold various items which include but are not limited to small hand tools such as wrench sockets, small medicine bottles, medical vials, test tubes and many other uses in which articles are desired to be held in assembled relation to other articles by a secure and firm holding arrangement. The receiver 18 will securely hold, retain, suspend, protect and resist shock and vibration for various articles which may vary in size, weight and configuration such as but not limited to bomb fuses, rockets, mortars, shells, torpedos and other explosive devices in which protection of the article is quite important.

The resilient spring arrangement 36 illustrated in FIGS. 1–3 includes U-shaped spring wires which resiliently engage and bias opposed receiver wall segments radially inwardly. It is pointed out that various spring arrangements or resilient arrangements may be employed including endless rubber bands, formed wire springs interconnecting adjacent wall segments at any point along the length thereof, coil springs connecting adjacent wall segments or completely encircling all of the wall segments, spring strips of various configurations connecting adjacent wall segments or opposed wall segments with various arrangements being provided to connect the resilient arrangements to the wall segments including projecting pins on the wall segments, apertures or sockets in the wall segments for receiving projections on the resilient arrangements and recesses or notches in ribs on the wall segments to receive and position the resilient arrangements in order to retain them in position peripherally of the wall segments and to retain them longitudinally in relation to the wall segments.

Figure 4:
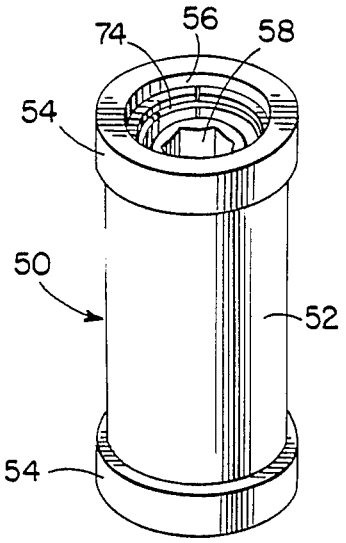
FIG. 4 is a perspective view of another embodiment of the article holder.
Figure 5:
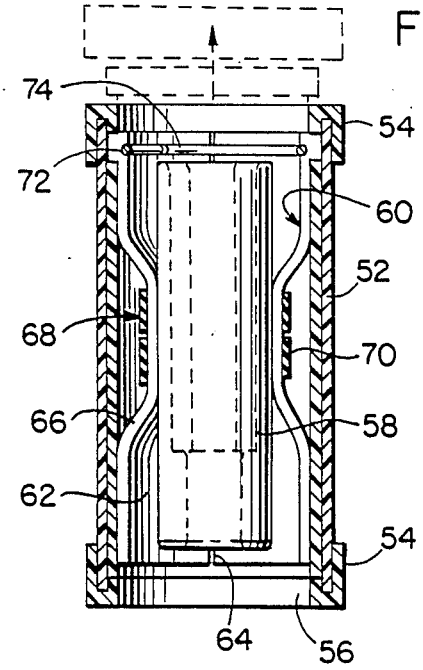
FIG. 5 is a longitudinal, sectional view of the structure of FIG. 4.
Figure 6:
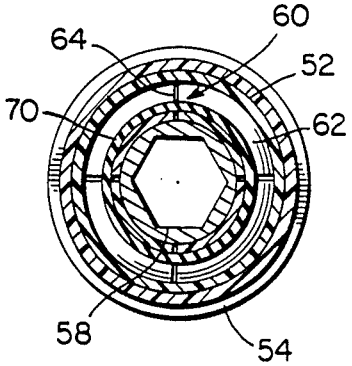
FIG. 6 is a transverse, sectional view of the embodiment illustrated in FIG. 5.

The embodiment illustrated in FIGS. 4–6 is generally designated by reference numeral 50 and includes a double tapered construction and includes a generally cylindrical body 52 having an end cap 54 on each end thereof which may be attached to the body 52 in any suitable manner such as by frictional gripping, screw threaded arrangement, glue or other permanent arrangements with each end cap including a central opening 56 to define an entrance from either end for an article 58 such as a wrench socket or any other article to be retained. Internally of the body 52 is a receiver generally designated by the numeral 60 which includes a plurality of wall segments 62 spaced from each other and separated from each other by a slot 64 which extends from end-to-end of the segments 62. The outer end portion of each segment 62 is inclined outwardly as at 66 so that the top and bottom portions of the segments 62 diverge from each other thus forming a double tapered receiver 60. A resilient arrangement 68 encircles the wall segments 62 and may be in the form of an endless resilient member such as a rubber band 70 which will resist outward radial movement of the segments 62 in relation to each other and bias the segments radially inwardly. To prevent inward collapse of the segments 62, each outer end thereof is provided with an inwardly facing groove 72 which receives an internal spring ring 74 which may be a split ring that resiliently engages the inwardly facing groove 72 in order to retain the outer ends of the segments 62 so that the edges of the slots 64 will be retained in alignment with each other and the segments will define a peripheral wall of segmented construction that is biased inwardly by the resilient arrangement 68 for securely holding the article 58 within the interior of the receiver 60.

Figure 7:
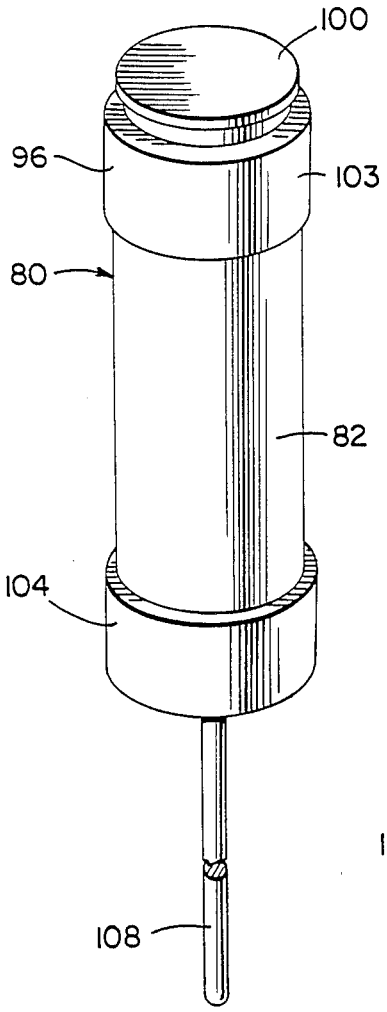
FIG. 7 is a perspective of another embodiment of the article holder which includes an article ejection device.
Figure 8:
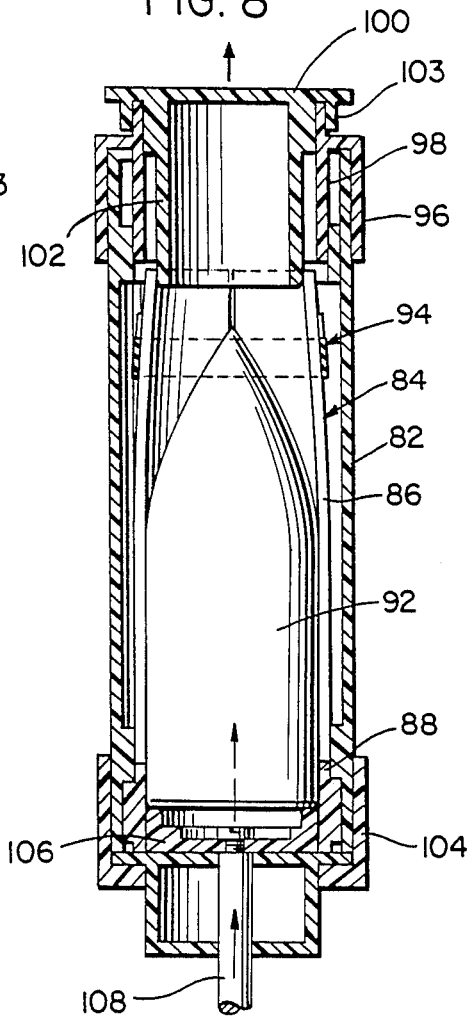
FIG. 8 is a longitudinal sectional view of the article holder of FIG. 7.
Figure 9:
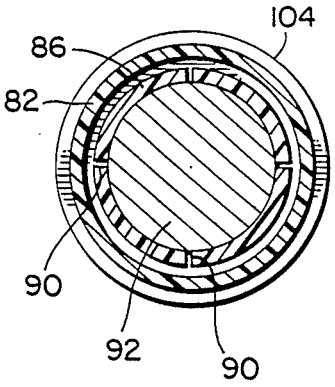
FIG. 9 is a horizontal, sectional view of the embodiment of the article holder illustrated in FIG. 8.

The embodiment of the invention illustrated in FIGS. 7–9 is generally designated by the numeral 80 and includes a body 82 which may be of cylindrical hollow construction or any other shape and configuration. The hollow body includes a receiver generally designated by the numeral 84 therein which includes a plurality of segments 86 which are joined in a continuous peripheral body 88 at one end thereof or the segments may be separated throughout their length by slots 90 for receiving and gripping an article 92 positioned therein which may be in the form of a shell having a tapered upper end. A resilient arrangement 94 engages the periphery of the segments 86 and may be in the form of resilient bands or other spring devices engaging notches formed in ribs on the exterior of the segments 86 to bias the segments 86 into surface-to-surface frictional engagement with the article 92. In this embodiment of the invention, an end cap 96 is provided with a neck 98 which receives a closure cap 100 having a projecting closure members 102 and 103 telescoped into and telescoped over the neck 98. The other end of the body includes an end cap 104 connected to the body 82 with a piston 106 positioned interiorly of the bottom of the body 82 and the piston 106 is provided with a plunger or rod 108 projecting through the end cap 104 so that when the plunger or rod 108 is moved inwardly, it will move the piston 106 inwardly and move the article 92 upwardly or longitudinally in the receiver 84 for ejection out of the opposite end of the body 82 when the cap 100 has been removed.

In the embodiments illustrated in FIGS. 4–9, both ends or either end of the housing and receiver may be provided with a closure member similar to the closure member 100 illustrated in FIGS. 7 and 8 with suitable seal means being provided t maintain the environmental integrity of the interior of the holder. Also, the inner retaining ring as designated by reference numeral 74 may be provided in both ends or either end of the receiver. Also, the rod 108 in the embodiment illustrated in FIG. 8 may be provided with a sealed relationship to the end cap 104. Another significant use of the invention is the incorporation of the receiver concept into beverage supporting trays such as those used on the center hump of an automobile so that the resiliently biased segments will frictionally grip the periphery of the bottom portion of a beverage container to prevent the container from tipping over but yet enabling the beverage container to be easily removed to consume the contents thereof. This is especially useful when the vehicle operator purchases an open topped container of coffee or similar beverages at a convenience store, fast food outlet or the like and immediately turns sharp corners when exiting from the establishment at which the beverage was purchased and when entering entrance ramps to interstate highways and the like.

Figure 10:
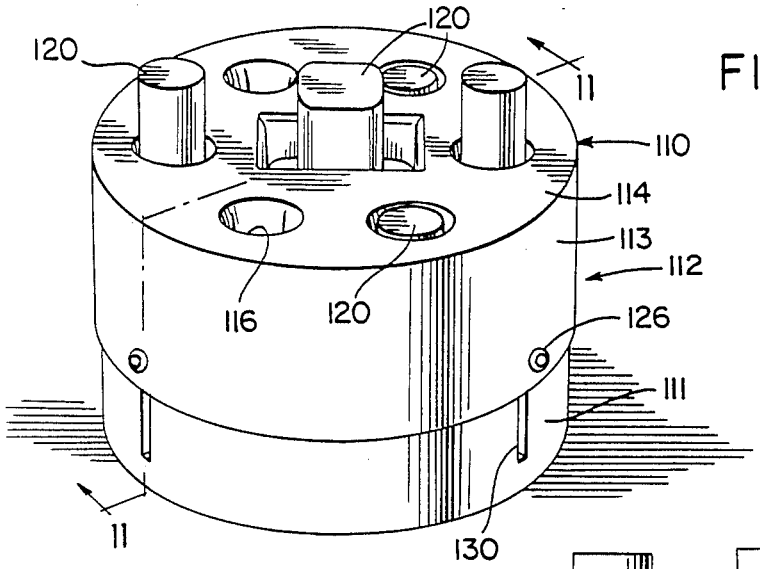
FIG. 10 is a perspective view of another embodiment of the invention in which articles can be partially ejected for access.
Figure 11:
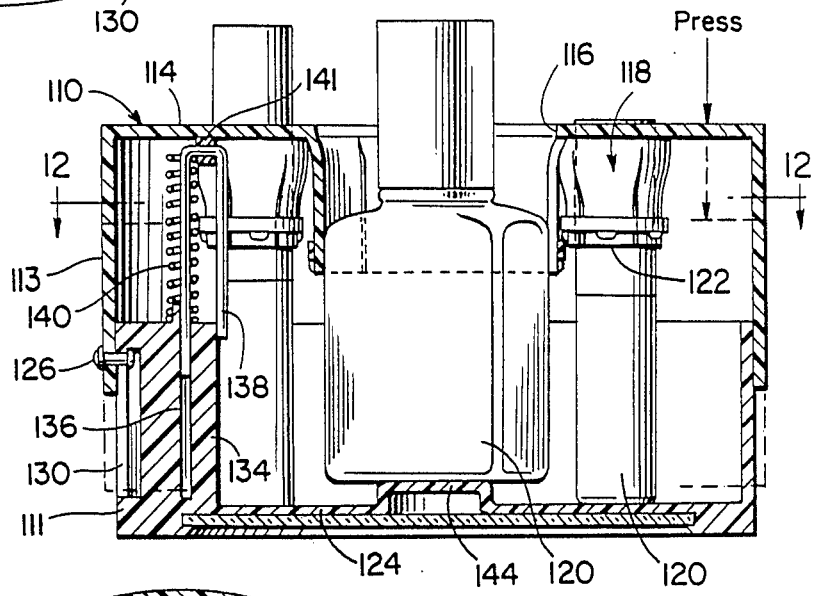
FIG. 11 is a vertical sectional view taken along section line 11—11 on FIG. 10.
Figure 12:
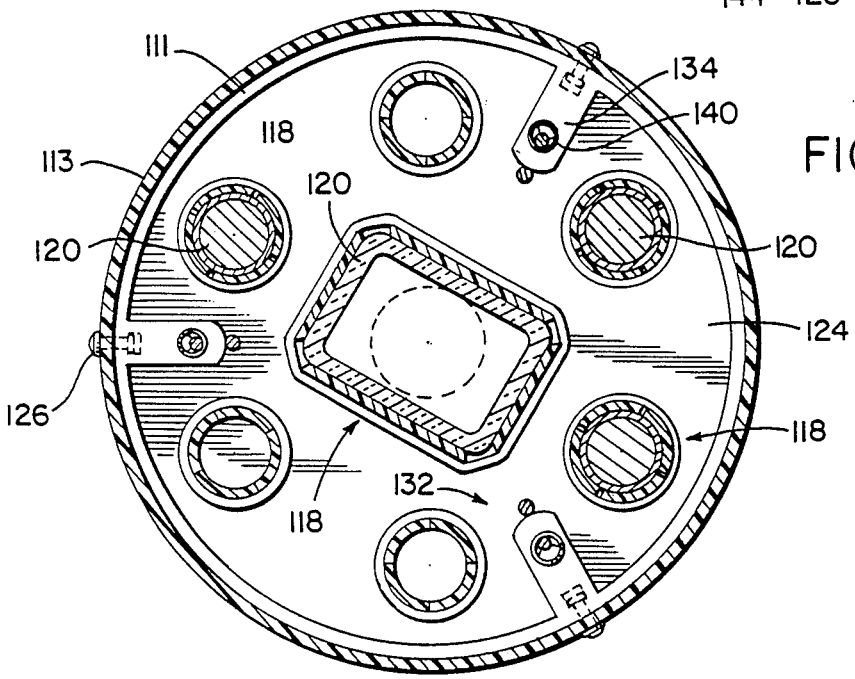
FIG. 12 is a horizontal sectional view taken along section line 12—12 on FIG. 11.

FIGS. 10–12 illustrate another embodiment of the invention in the form of a holder for lipstick, eyebrow pencils, mascara and other similar cosmetic products which are normally used when a person applies make-up. The containers for these products are usually placed on a dresser, in a tray or other similar holder and they frequently fall over due to their small cross-sectional configuration. This embodiment of the article holder is generally designated by the numeral 110 and includes a generally cylindrical housing 112 which may be of any suitable configuration which includes an upper cylindrical member 113 and a lower cylindrical member 111 oriented in telescopic relation. The upper cylindrical member 113 includes a top wall 114 having a plurality of openings 116 therein with each of the openings including a receiver structure 118 which includes the same concept of biased segments for frictionally gripping various articles in the form of cosmetic containers 120 with the receivers being of different shapes and sizes to effectively grip the containers over large surface areas but still enabling the containers to be readily removed therefrom and reinserted back into the receivers through the openings 116.

The receivers 118 are provided with an open lower end 122 so that the containers 120 can be pushed downwardly beyond the lower end of the receivers 118 so that the upper ends of the containers can be oriented flush with the top wall 114 in some instances and, in some instances, the containers will still project above the top wall 114 even when inserted completely into the receivers. The lower cylindrical member is provided with a bottom wall 124 which will contact the lower ends of the containers 120 when the upper housing 113 is pushed downwardly and telescoped downwardly over the lower housing 111 which movement will cause the containers 120 to move to a position above the top wall 114 or to an elevated position compared to their original position. In order to guide the housing 113 in relation to the housing 111, the housing 113 includes a plurality of pins 126 which slide in slots 130 formed in the lower housing 111. Various other arrangements may be provided for guiding these structures including ribs and grooves, various fastening arrangements and the like. A plurality of spring assemblies 132 are interposed between the housings 111 and 113 with each spring assembly including a support projection 134 having an upwardly opening recess 136 receiving a generally U-shaped spring guide 138 having a coil compression spring 140 mounted thereon and extending above the projection 134. The upper end of the guide 138 includes a resilient bumper 141 engaged with the under surface of the top wall 114 of the top housing 113. Thus, as the top housing 113 is pushed downwardly, the springs 140 will be compressed and, at the same time, the lower ends of the containers 120 will engage the upper surface of the bottom wall 124 and be simultaneously ejected upwardly in relation to the receivers 118 so that when the top housing 113 is released and it returns to its uppermost position, the containers 120 will be retained in their elevated or ejected position so that the upper ends thereof are readily accessible or more accessible to being gripped and removed by a person using the device. This also assures that the cosmetic containers will be retained in an orderly manner and when a particular container has been removed for use, it can be readily reinserted in the same receiver from which it was removed.

The bottom wall 124 may include a recessed downwardly facing mirror 142 which can be utilized when the device is inverted since the receivers will retain the containers in place. Also, the bottom wall 124 may include an upwardly offset portion 144 to engage shorter containers and to form a recess to receive the mirror 142. This enables the holder 110 to be used as a portable unit such as a cosmetic carrying case in which event a mirror will be readily available regardless of where the cosmetics are used. Also, this assembly can be incorporated into a cosmetic case in the form of a removable tray or the like so that the cosmetic case can utilize a bottom area for hair sprays, hair dryers and other similar equipment with the cosmetic holder being incorporated into a removable tray positioned above the stored hair spray, hair dryer, curling iron and the like. This unit also can be mounted in various positions in the bathroom such as on the top of a toilet flush tank, countertop or any other supporting surface to maintain the cosmetic containers in secure and readily available position.

In all embodiments of the invention, the shape, size and configuration of the components may be varied and the material from which the components is constructed is preferably plastic having memory and elastic characteristics although various dissimilar materials may be used in making the holder. The various components may be connected and assembled in various arrangements either as permanent components or replaceable components as may be deemed appropriate.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. An article holder comprising an article receiver including a plurality of radially expandable segments for engaging opposed surface areas of an article received in the receiver, resilient means contacting the segments for resiliently biasing the segments into contact with the article to securely hold the article, said segments corresponding in shape and size to the size of the article for engaging the article over a substantial portion of the peripheral surface.

2. The article holder as defined in claim 1 wherein said segments have one end connected to a member and defining an opening in the member through which the article is inserted into the receiver.

3. The article holder as defined in claim 2 wherein said resilient means includes spring wire means engaging opposed segments to resist outward radial movement of the opposed segments and bias the opposed segments inwardly.

4. The article holder as defined in claim 3 wherein said spring wires are of U-shaped configuration and have end portions engaging the outer portions of opposed segments and a central portion oriented outwardly of the other segments of the receiver.

5. An article holder comprising an article receiver including a plurality of radially movable segments engaging opposed surface areas of an article received in the receiver, resilient means contacting the segments and resiliently biasing the segments into contact with the article to securely hold the article, said receiver being disposed interiorly of a peripheral wall with the segments being completely free from each other with the segments including diverging end portions, means engaging the interior of the end portions of the segments to retain the segments alongside each other and prevent inward collapse thereof, said resilient means being disposed peripherally of the central portion of the segments and engaging the outer surface thereof.

6. The article holder as defined in claim 5 wherein said segments are disposed in a peripheral body having a length generally equal to the length of the segments and an end cap engaging each end of the body and having a central opening with the end caps retaining the assembled segments in the body.

7. The article holder as defined in claim 1 wherein said receiver includes a piston movably positioned in one end thereof and including a rod connected to the piston for moving the piston through the receiver to eject an article held by the receiver.

8. The article holder as defined in claim 7 wherein said receiver is retained in a cylindrical body with an end cap at one end of the cylindrical body receiving the rod for positioning and guiding the rod during reciprocation of the piston in relation to the receiver, the other end of the body including an opening provided with a protective closure member for closing the interior of the cylindrical body and protecting the article therein with the closure being removable to enable ejection of the article from the receiver.

9. The article holder as defined in claim 1 wherein said article receiver is mounted in an upper housing which telescopically engages a lower housing, spring means biasing the housings apart, guide means guiding the housings in relation to each other during telescopic movement, said receiver having an open end to enable a container to be inserted into the receiver from the upper end of the upper housing and project below the lower end of the receiver for engagement with tee lower housing when the upper housing is depressed downwardly to eject the container from the receiver so that the upper end thereof is positioned above the top of the upper housing for access with the container being retained in its elevated position when the spring means returns the upper housing to its original position.

10. The article holder as defined in claim 9 wherein said upper housing includes a plurality of openings of various sizes and shapes with each of the openings having a receiver associated therewith for receiving a plurality of variously shaped and sized cosmetic containers with some of the containers having a length for disposal of the upper end of the container generally flush with the top of the upper housing for storage but being projected upwardly therefrom for access when the upper housing is depressed.

11. The article holder as defined in claim 10 wherein said guide means includes a pin and slot arrangement in said housings, said spring means including a plurality of springs interposed between the housings, each spring including a longitudinal portion guided by a guide member that is vertically adjustably connected to the lower housing.

12. The article holder as defined in claim 9 wherein the lower housing includes a recessed mirror in the lower surface thereof to provide a mirror regardless of the place of use of the holder.

13. The article holder as defined in claim 9 wherein said housings are of cylindrical configuration and provided with a plurality of receivers spaced circumferentially therein with at least one receiver positioned centrally of the housings.

14. The structure as defined in claim 5 wherein each of said segments is elongated and provided with an inwardly offset central portion, said resilient means including a resilient band disposed peripherally of the exterior of the inwardly offset central portions of the segments.

15. The structure as defined in claim 5 wherein said peripheral wall includes end caps engaging each end of the peripheral wall and retaining the segments in the peripheral wall be preventing axial displacement of the segments.

16. An article holder comprising a cylindrical open ended body having an end cap on each end thereof, a plurality of independent article gripping segments within the body with the segments having a length generally equal to the length of the body, said segments being separated from each other by continuous longitudinal slots, each of said segments including an inwardly offset central portion having a resilient band disposed peripherally against the outer surface of the central offset portions of the segments thus biasing the segments inwardly and resisting radially outward expansion thereof, said end caps retaining the segments in the body against axial displacement, and resilient means extending peripherally of the interior of the segments and engaging each of the segments to prevent inward collapse thereof when the segments are not grippingly engaging an article, the outer surface of the end portions of the segments being radially confined by the cylindrical body and being constructed of resilient material with the inwardly offset central portion adapted to grippingly engage an article inserted into the article holder.

* * * * *